US005670305A

United States Patent [19]

Gordon et al.

[11] Patent Number: 5,670,305

[45] Date of Patent: Sep. 23, 1997

[54] PHOTOGRAPHIC PROCESSING SOLUTION CONTAINING TERNARY FERRIC-COMPLEX SALTS

[75] Inventors: Stuart Terrance Gordon, Pittsford; Keith Henry Stephen, Rochester; Eric Richard Brown; Celia Ann DeAndrea, both of Webster; Mary Morris Podhorecki, Rochester; William George Henry, Caledonia, all of N.Y.

[73] Assignee: Eastman Kodak Company, Rochester, N.Y.

[21] Appl. No.: 622,236

[22] Filed: Mar. 22, 1996

Related U.S. Application Data

[63] Continuation of Ser. No. 128,626, Sep. 28, 1993, abandoned.

[51] Int. Cl.[6] ..... G03C 7/42

[52] U.S. Cl. ..... 430/460; 430/393; 430/430; 430/461

[58] Field of Search ..... 430/393, 430, 430/460, 461

[56] References Cited

U.S. PATENT DOCUMENTS

| | | | |
|---|---|---|---|
| 3,997,348 | 12/1976 | Shimamura et al. . | |
| 4,294,914 | 10/1981 | Fyson . | |
| 4,748,105 | 5/1988 | Kadota et al. . | |
| 4,774,169 | 9/1988 | Kuse et al. . | |
| 4,908,300 | 3/1990 | Koboshi et al. . | |
| 4,910,125 | 3/1990 | Haruuchi et al. . | |
| 4,914,008 | 4/1990 | Kurematsu et al. . | |
| 5,006,438 | 4/1991 | Ishikawa et al. | 430/490 |
| 5,149,618 | 9/1992 | Tappe et al. | 430/460 |
| 5,288,597 | 2/1994 | Hayashi | 430/611 |
| B1 4,537,856 | 5/1989 | Kurematsu et al. . | |

FOREIGN PATENT DOCUMENTS

| | | |
|---|---|---|
| 412532 | 2/1991 | European Pat. Off. . |
| 498950 | 8/1992 | European Pat. Off. . |
| 534086 | 3/1993 | European Pat. Off. . |
| 3939755 | 6/1991 | Germany . |
| 3939756 | 6/1991 | Germany . |
| 4029805 | 3/1992 | Germany . |
| 4031757 | 4/1992 | Germany . |

*Primary Examiner*—Hoa Van Le

*Attorney, Agent, or Firm*—Sarah Meeks Roberts; J. Lanny Tucker

[57] ABSTRACT

A composition for bleach-fixing a silver halide photographic element comprising a fixing agent and a ternary ferric-complex salt formed by a tetradentate ligand and a tridentate ligand and a method of bleach-fixing using said composition.

21 Claims, 2 Drawing Sheets

300
250
200
150
100
50
0
-50
-100
-150
-200
$E_{1/2}$ mV vs SCE
2
3
4
5
6
7
8
9
pH
1
2
3
4

300
250
200
150
100
50
0
-50
-100
-150
-200
$E_{1/2}$ mV vs SCE
2
3
4
5
6
7
8
9
pH
1
2
3
4

PHOTOGRAPHIC PROCESSING SOLUTION CONTAINING TERNARY FERRIC-COMPLEX SALTS

This is a Continuation of application Ser. No. 08/128,626, filed Sep. 28, 1993, now abandoned.

FIELD OF THE INVENTION

The present invention relates to a method for processing imagewise exposed color silver halide elements and, in particular, to a rapid processing method in which the desilvering performance is improved.

BACKGROUND

During processing of color silver halide elements the silver is oxidized to a silver salt by a bleaching agent, most commonly an iron-complex salt of an aminopolycarboxylic acid, such as the ferric ammonium complex salt of ethylenediaminetetraacetic acid (EDTA). The bleaching step is followed by removal of this silver salt and any unused silver halide by a fixing agent which renders the silver salts and silver halide soluble. Bleaching and fixing may be effected separately or together as a bleach-fixing step.

The bleaching reaction rate strongly depends on the oxidizing potential of the iron-complex salt which in turn depends on the structure of the aminopolycarboxylic acid. Compounds such as ethylenediaminetetraacetic acid (EDTA) and nitrilotriacetic acid (NTA) afford iron complexes with weak oxidizing strength. Rapid bleaching cannot be attained without the use of added bleach-accelerating compounds. On the other hand, some aminopolycarboxylic acids can afford too strong an oxidizing strength which leads to 1) unwanted dye formation in the bleach and, 2) if used in a bleach-fix, to poor solution stability of the bleach-fix solution due to oxidation of the fixing agents; such oxidation can cause precipitation of sulfur in the solution. Furthermore, some of the chelating agents forming iron-complex salts are not readily biodegradable in publicly-owned treatment works or receiving waters.

Bleaching solutions have been developed which contain more than one ligand and which help provide rapid bleaching without unwanted dye formation, but such solutions contain two distinct iron-complex salts. For example, in KODAK FLEXICOLOR Bleach II, one salt is ferric ammonium ethylenediaminetetraacetic acid (EDTA) and the other is ferric ammonium-1,3-propylenediamine tetraacetic acid (PDTA). While such mixtures are stable and provide excellent bleaching, neither of these iron-complex salts is readily biodegradeable. Similarly in EP 430,000/DE 3,939,755 (Tappe et.al.), bleach-fix formulations have been described with mixtures of ligands. However, the ligands described are both tetradentate chelating agents that form two distinct iron-complex salts which, in combination with thiosulfate in bleach-fix formulations, lack stability. Also described in EP 534,086, (Kuse) are mixtures of bidentate ligands, used as pH buffering agents, and tetradentate ligands. U.S. Pat. No. 4,910,125 (Haruuchi et al.) describes a mixture of a tridentate ligand with a variety of aminopolycarboxylic acids.

It is therefore desired to provide a bleach-fixing composition which is both stable and biodegradable, and which has good bleaching efficiency. It is also desired to provide a processing method using such a composition.

SUMMARY OF THE INVENTION

This invention provides a composition for bleach-fixing an imagewise exposed and developed silver halide photographic element comprising a fixing agent and a ternary ferric-complex salt formed by a tetradentate ligand and a tridentate ligand. In one embodiment the tridentate ligand is represented by Formula I and the tetradentate ligand is represented by Formula II

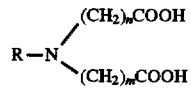

(I)

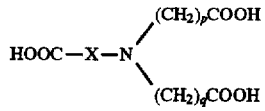

(II)

wherein

R is H or an alkyl group;

m,n,p and q are 1, 2, or 3; and

X is a linking group.

This invention further provides a method of desilvering an imagewise exposed and developed silver halide photographic element comprising processing the silver halide element in the above bleach-fix composition.

This invention provides a bleach-fix solution in which both a tridentate ligand and a tetradentate ligand are complexed with ferric ion to form a ternary complex. This bleach-fixing solution contains biodegradable ligands, shows good desilvering ability, and has excellent solution stability.

FIGURES

FIGS. 1 and 2 depict the potentials of solutions containing equal concentrations of ferrous ion and ferric ion with certain aminopolycarboxylic acid ligands as described in Example 1.

DETAILED DESCRIPTION

Figure 1:
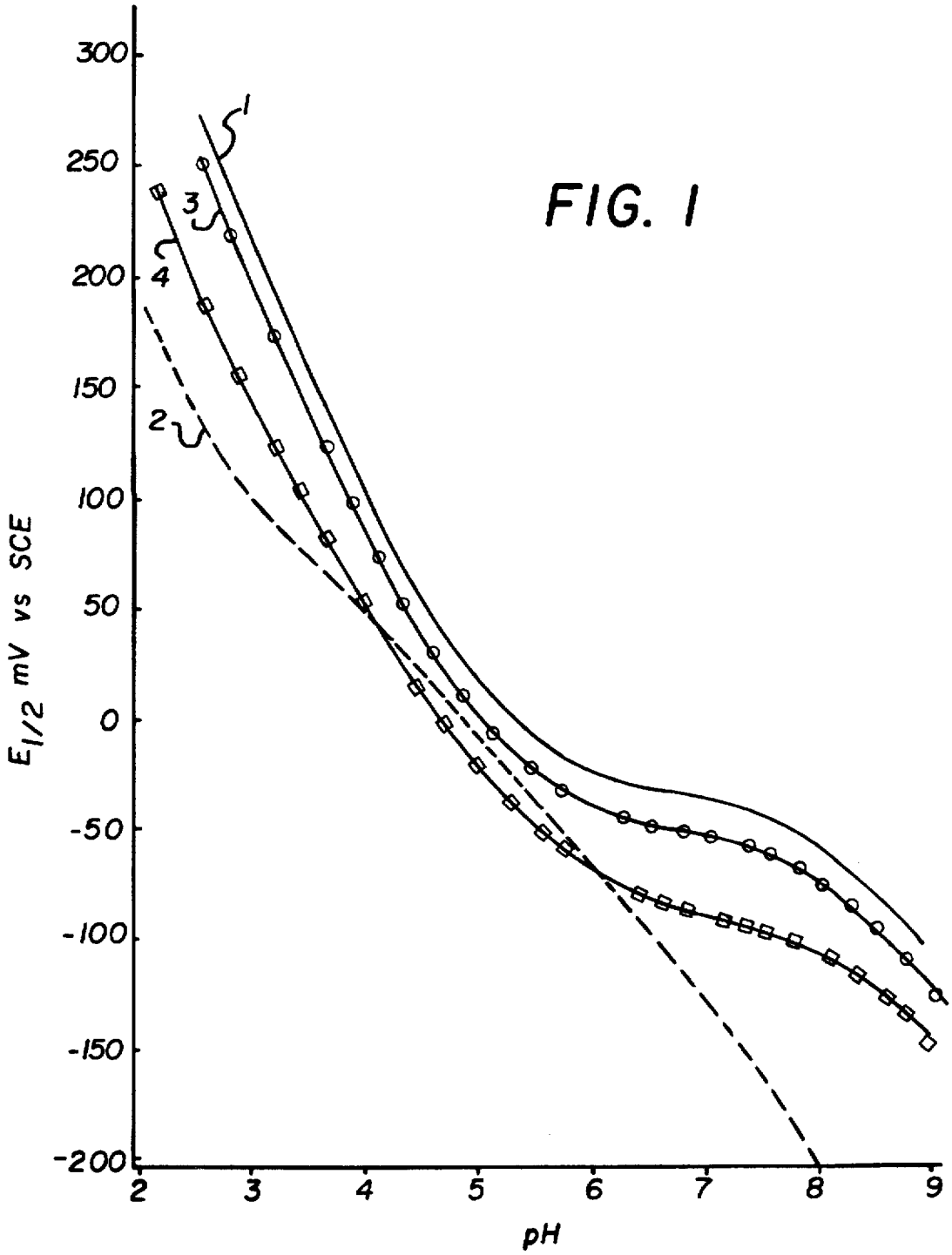

The bleach-fixing compositions of this invention contain an iron chelate complex which is a ternary ferric-complex salt formed by a tetradentate ligand and a tridentate ligand. A ternary complex is the iron salt complex formed from two distinctly different ligand structures. Compounds which contain three groups that bind to the ferric ion are tridentate chelating agents. Compounds with four binding sites to the ferric metal ion are tetradentate ligands.

The formation of a ternary complex from a metal ion salt and two different chelating compounds can be measured by direct pH titration methods as described by Irving and Rossoti in *Journal of the Chemical Society*, 2904 (1954). Alternatively, spectral methods can be used if the complexes have sufficiently different absorption spectra from the parent ligands or the uncomplexed metal ion salt.

Potentiometric measurements of the type described by Bond and Jones in *Journal of the Faraday Society*, Vol. 55, 1310 (1959) can also be used to study ternary complexation. Potentials are measured in a solution containing equal concentrations of ferric-ion salt and ferrous-ion salt to which are added different amounts of each of the two chelating compounds of interest. Using this method a reference solution containing a large amount of only the tridentate ligand is prepared and the potential is measured as a function of pH according to the method of Bond and Jones. Then a second solution is prepared containing both the tridentate ligand and the tetradentate ligand and the potential of the second solution is measured according to the same method. Solutions containing a combination of a tridentate ligand and a tetradentate ligand showing a substantial negative potential shift (typically this is greater than about 25 mV) from the tridentate ligand-only solution have formed a ferric-ion salt ternary complex.

The resultant ternary complex with ferric ion controls the oxidizing potential of the bleaching solution to rapidly oxidize developed silver without decreasing the stability of the fixing agents in solution. Ferric ion complexes with two tridentate ligands, e.g., methyliminodiacetic acid, form unstable bleach-fixing solutions because the potential of said complex is too oxidizing. In addition such complexes can leave iron in the photographic material in subsequent processing solutions such as washes and stabilizers. Ferric-ion complexes with one tetradentate ligand do not completely satisfy the coordination requirements of ferric ion and the complex readily undergoes hydrolysis. The hydrolysis product does not bleach silver rapidly and is prone to further decomposition and deposition of iron in the photographic material and in subsequent processing solutions such as washes and stabilizers. Ferric-ion complexes formed from two tetradentate ligands have such weak oxidizing potentials that silver is not completely removed even with extended processing time. Only the combination of one tridentate chelating compound and one tetradentate compound form a ternary complex with ferric ion to control the potential for optimum silver oxidation rate and long term solution stability.

The preferred ligands are ionized aminopolycarboxylic acids, although other ligands which form ferric ion salt complexes having bleaching ability and which meet the complexation requirements of this invention may be used. Such ligands might include dipicolinic acid or ligands having PO3H2 groups. The tridentate aminopolycarboxylic acids which may be used are those which have only three binding sites to the ferric ion, that is they have no additional substituents which might bind to the ferric ion. Further, they must be water soluble, form ferric complexes which have bleaching ability and be compatible with silver halide bleaching systems. The tetradentate aminopolycarboxylic acids which may be used must meet the same criteria except they must contain only four binding sites. Preferably the aminopolycarboxylic acids are biodegradable. More preferred are solutions containing ternary complexes formed from two different aminopolycarboxylic acids, one of which is a tridentate ligand represented by formula (i) and the second a tetradentate ligand represented by formula (II) below:

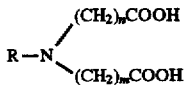

(I)

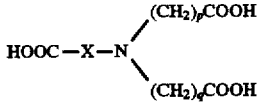

(II)

R represents H, or a substituted or unsubstituted alkyl group, aryl group, arylalkyl group or heterocyclic group. Preferably R is an alkyl group and more preferably it contains 1 to 3 carbon atoms. The letters m, n, p and q are independently 1, 2, or 3. More preferably m, n, p and q are 1. The substituents on R can be any Group which does not bind to ferric ion, examples of which are

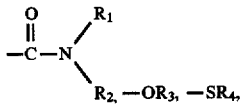

where $R_1$ through $R_4$ represent an alkyl group or hydrogen atom. The linking group, X, may be any group which does not bind ferric ion and which does not cause the compound to be water insoluble. Preferably X is a substituted or unsubstituted alkylene group, arylene group, arylalkylene group or heterocyclic group and more preferably X is an alkylene chain of one to three carbon atoms which may also be substituted with other non-complexing groups such as a methyl or aryl group.

Representative examples of tridentate ligands which can be described by formula (I) are listed below, but the compounds are not limited by these examples. The most preferred compound is methyliminodiacetic acid.

List I

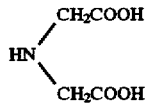

1.

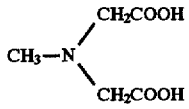

2.

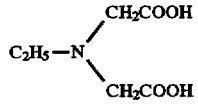

3.

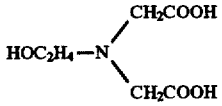

4.

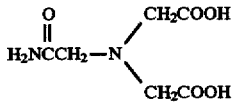

5.

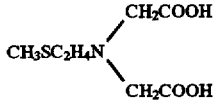

6.

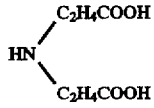

7.

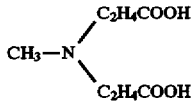

8.

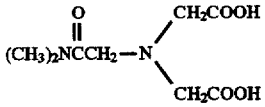

9.

Representative examples of tetradentate compounds which can be described by formula (II) are listed below but the compounds are not limited by these examples. The most preferred compound is nitrilotriacetic acid.

List II

1. 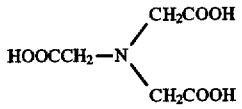

2. 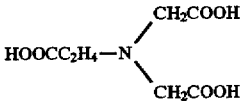

3. 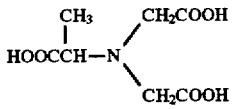

4. 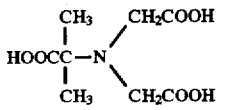

5. 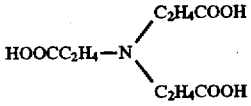

6. 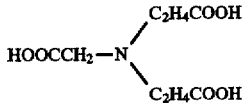

Many of the tridentate and tetradentate ligands of this invention are commercially available or can be prepared by methods known to those skilled in the art.

The concentration ratios of metal ion salt and compounds of formula (I) and formula (II) must be in a specific range of values to optimize formation of the ternary complex. The ratio of tetradentate chelate to ferric ion should be in the range of about 0.9 to 1.5, preferably in the range of about 1.0 to 1.2 and most preferably in the range of about 1.01 to 1.05. The ratio of tridentate chelate to ferric ion should be in the range of about 0.5 to 10, preferably in the range of about 1 to 5 and most preferably in the range of about 1 to 3. The metal salt in the bleaching solution should have a concentration of about 0.01M to 1.0M to affect rapid silver removal. More preferably the concentration of the ferric-ion salt is between 0.05M and 0.4M.

The pH value of the bleach-fix solution of the present invention helps establish formation of the ternary complex of the ferric-ion salt and the two distinct chelating compounds and aids in stability of the fixing agent. As such, the pH value is preferably in the range of about 3.0 to 8.0 and most preferably in the range of about 4.0 to 6.5.

In order to adjust the pH value to the above-mentioned range and maintain good pH control, a weak organic acid with a $pK_a$ between 4 and 6, such as acetic acid, glycolic acid or malonic acid, can be added in conjunction with an alkaline agent such as aqueous ammonia. This buffering acid helps maintain the consistent performance of the silver oxidation reaction. The bleach-fix solution of the present invention contains known fixing agents, such as thiocyanate, thiosulfate, and thioethers, with thiosulfate salts, such as ammonium thiosulfate, being preferred. For environmental reasons potassium or sodium may be the preferred counter ion. The concentration of fixing agent is preferably between 0.1M and 3.0M, more preferably between 0.2M and 1.5M.

The bleach-fixing solution may also contain a preservative such as sulfite, e.g., ammonium sulfite, a bisulfite, or a metabisulfite salt. These compounds are present from 0 to 0.5M and more preferably 0.02M to 0.4M. Further, the bleach-fix may contain bleaching and fixing accelerators.

The bleach-fix solution of this invention can be directly replenished to the bleach-fix. The volume of replenishment solution added per $m^2$ of the silver halide photographic element can be considered to be a function of the amount of silver present in the photosensitive material. It is preferred to use low volumes of replenishment solution so low silver materials are preferred. The replenishment rate may be between 1 and 1000 $ml/m^2$ and more preferably between 50 and 250 $ml/m^2$. Also, the bleach-fix overflow can be reconstituted as described in U.S. Pat. No. 5,063,142 and European Patent Application 410,354 or in U.S. Pat. No. 5,055,382 (Long et al.). Processing time may be about 10 to 240 sec with 30 to 60 sec being preferred and 30 to 45 sec being most preferred.

The photographic elements to be processed can contain any of the conventional silver halides as the photosensitive material, for example, silver chloride, silver bromide, silver bromoiodide, silver chlorobromide, silver chloroiodide, and mixtures thereof. Preferably, however, the photographic element is a high chloride element, containing at least 50 mole silver chloride and more preferably 90 mole % silver chloride.

The photographic elements of this invention can be single color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. Pat. No. 4,362,806 issued Dec. 7, 1982. The element can contain additional layers such as filter layers, interlayers, overcoat layers, subbing layers and the like. The element may also contain a magnetic backing such as described in No. 34390, *Research Disclosure*, November, 1992.

In the following discussion of suitable materials for use in the emulsions and elements of this invention, reference will be made to *Research Disclosure*, December 1989, Item 308119, published by Kenneth Mason Publications, Ltd., Dudley Annex, 12a North Street, Emsworth, Hampshire P010 7DQ, ENGLAND, the disclosures of which are incorporated herein by reference. This publication will be identified hereafter by the term "Research Disclosure".

The silver halide emulsions employed in the elements of this invention can be either negative-working or positive-working. Examples of suitable emulsions and their preparation are described in Research Disclosure Sections I and II and the publications cited therein. Other suitable emulsions are (111) tabular silver chloride emulsions such as described in U.S. Pat. No. 5,176,991 (Jones et al); U.S. Pat. No. 5,176,992 (Maskasky et al); U.S. Pat. No. 5,178,997 (Maskasky); U.S. Pat. No. 5,178,998 (Maskasky et al); U.S. Pat. No. 5,183,732 (Maskasky); and U.S. Pat. No. 5,185,239 (Maskasky) and (110) tabular silver chloride emulsions such as described in EPO 534,395, published Mar. 31, 1993 (Brust et al). Some of the suitable vehicles for the emulsion layers and other layers of elements of this invention are described in Research Disclosure Section IX and the publications cited therein.

The silver halide emulsions can be chemically and spectrally sensitized in a variety of ways, examples of which are described in Sections III and IV of the Research Disclosure.

The elements of the invention can include various couplers including, but not limited to, those described in Research Disclosure Section VII, paragraphs D, E, F, and G and the publications cited therein. These couplers can be incorporated in the elements and emulsions as described in Research Disclosure Section VII, paragraph C and the publications cited therein.

The photographic elements of this invention or individual layers thereof can contain among other things brighteners (examples in Research Disclosure Section V), antifoggants and stabilizers (examples in Research Disclosure Section VI), antistain agents and image dye stabilizers (examples in Research Disclosure Section VII, paragraphs I and J), light absorbing and scattering materials (examples in Research Disclosure Section VIII), hardeners (examples in Research Disclosure Section X), plasticizers and lubricants (examples in Research Disclosure Section XII), antistatic agents (examples in Research Disclosure Section XIII), matting agents (examples in Research Disclosure Section XVI) and development modifiers (examples in Research Disclosure Section XXI).

The photographic elements can be coated on a variety of supports including, but not limited to, those described in Research Disclosure Section XVII and the references described therein.

Photographic elements can be exposed to actinic radiation, typically in the visible region of the spectrum, to form a latent image as described in Research Disclosure Section XVIII and then processed to form a visible dye image, examples of which are described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

The color developing solutions typically contain a primary aromatic amino color developing agent. These color developing agents are well known and widely used in variety of color photographic processes. They include aminophenols and p-phenylenediamines.

Examples of aminophenol developing agents include o-aminophenol, p-aminophenol, 5-amino-2-hydroxytoluene, 2-amino-3-hydroxytoluene, 2-hydroxy-3-amino-1,4-dimethylbenzene, and the like.

Particularly useful primary aromatic amino color developing agents are the p-phenylenediamines and especially the N-N-dialkyl-p-phenylenediamines in which the alkyl groups or the aromatic nucleus can be substituted or unsubstituted. Examples of useful p-phenylenediamine color developing agents include: N-N-diethyl-p-phenylenediaminemonohydrochloride, 4-N,N-diethyl-2-methylphenylenediaminemonohydrochloride, 4-(N-ethyl-N-2-methanesulfonylaminoethyl)-2-methylphenylenediamine sesquisulfate monohydrate, 4-(N-ethyl-N-2-hydroxyethyl)-2-methylphenylenediamine sulfate, 4-N, N-diethyl-2, 2'-methanesulfonylaminoethylphenylenediamine hydrochloride, and the like.

In addition to the primary aromatic amino color developing agent, color developing solutions typically contain a variety of other agents such as alkalies to control pH, bromides, iodides, benzyl alcohol, anti-oxidants, antifoggants, solubilizing agents, brightening agents, and so forth.

Photographic color developing compositions are employed in the form of aqueous alkaline working solutions having a pH of above 7 and most typically in the range of from about 9 to about 13. To provide the necessary pH, they contain one or more of the well known and widely used pH buffering agents, such as the alkali metal carbonates or phosphates. Potassium carbonate is especially useful as a pH buffering agent for color developing compositions.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the conventional steps of bleach-fixing to remove silver and silver halide, washing and drying.

Typically, a separate pH lowering solution, referred to as a stop bath, is employed to terminate development prior to bleaching. A stabilizer bath is commonly employed for final washing and hardening of the bleached and fixed photographic element prior to drying. Conventional techniques for processing are illustrated by Research Disclosure, Paragraph XIX.

Preferred processing sequences for color photographic elements, particularly color negative films and color print papers, include the following:

(P-1) Color development/Stop/Bleaching-fixing/Washing/Stabilizing/Drying.

(P-2) Color development/Stop/Bleaching-fixing/Stabilizing/Drying.

(P-3) Color development/Bleaching-fixing/Washing/Stabilizing/Drying.

(P-4) Color development/Bleaching-fixing/Washing.

(P-5) Color development/Bleaching-fixing/Stabilizing/Drying.

(P-6) Color development/Stop/Washing/Bleaching-fixing/Washing/Drying.

In each of processes (P-1) to (P-6), variations are contemplated. For example, a bath can be employed prior to color development, such as a prehardening bath, or the washing step may follow the stabilizing step. Additionally, reversal processes which have the additional steps of black and white development, chemical fogging bath, light re-exposure, and washing before the color development are contemplated.

The following examples are intended to illustrate, without limiting, this invention.

EXAMPLE 1

The potential measurement experiments illustrating formation of a ferric ion ternary complex were performed as follows. Four potential measuring experiments were performed, each containing 2 mM ferric-ion salt and 2 mM ferrous-ion salt. The first experiment contained 50 mM of methyliminodiacetic acid as the tridentate ligand (Experiment 1). The second experiment contained the same iron salt concentration plus 5 mM nitrilotriacetic acid as the tetradentate ligand (Experiment 2). Experiments three and four respectively contained the same iron concentration and 50 mM methyliminodiacetic acid plus either 1 mM (Experiment 3) or 2 mM (Experiment 4) nitrilotriacetic acid.

Figure 2:
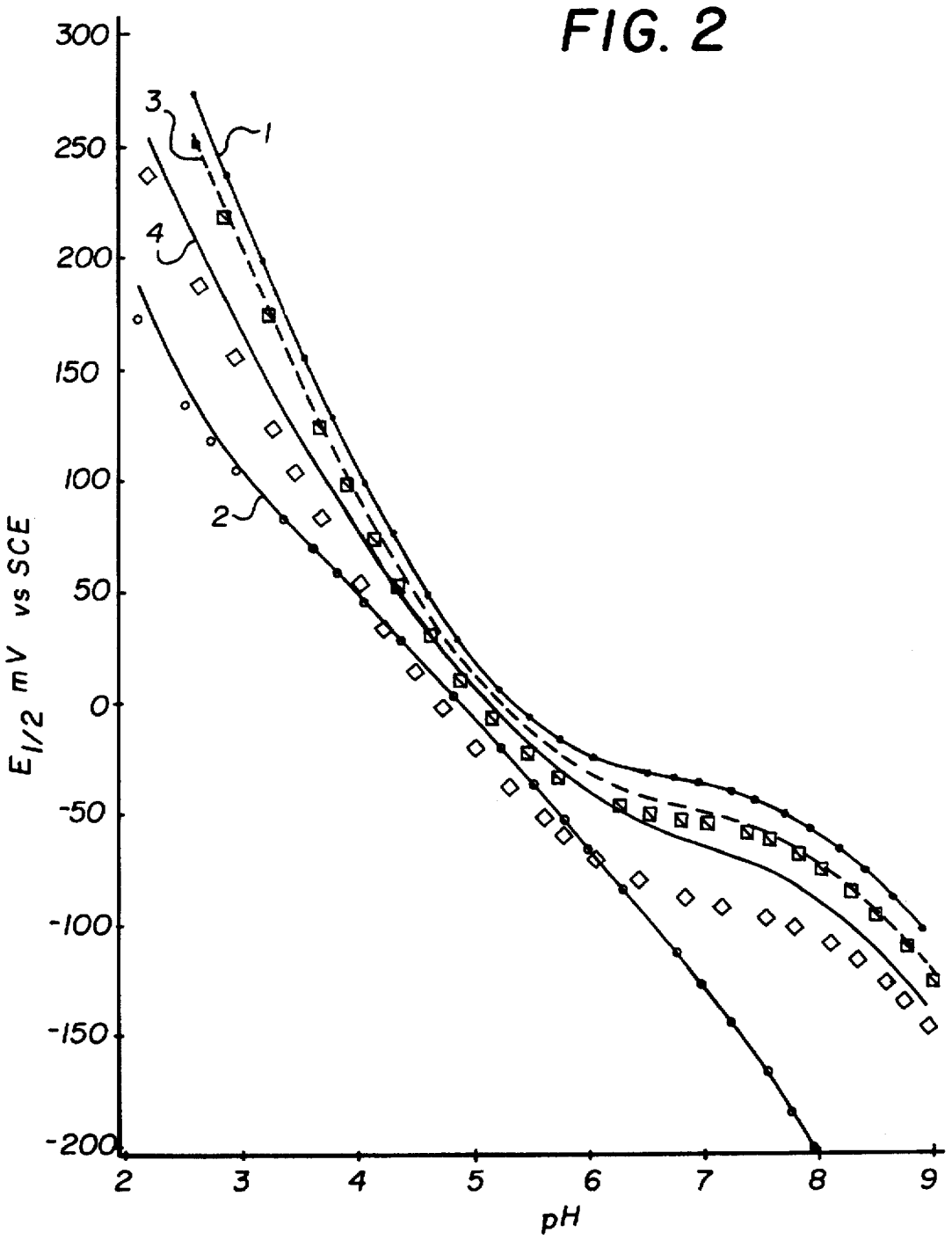

The resulting potentials of these experiments are plotted in the FIGS. 1 and 2 as a function of solution pH. The two solutions with both chelating compounds present (Experiments 3 and 4) have more negative potentials than the solution with just methyliminodiacetic acid present.

Between pH 4and pH 6 the potential in Experiment 4 is also more negative than the potential of the solution with only nitrilotriacetic acid present (Experiment 2). That a ternary complex of the ferric ion has formed is evidenced by the solid lines in FIG. 1 which are calculated potentials based on formation of such a complex. Without including such a complex, the potentials of Experiments 2 and 3 cannot be explained, as shown by the dotted lines in FIG. 2 which are calculated assuming no ferric-ion ternary complex has formed; rather only separate complexes of the tetradentate and tridentate ligands have formed.

EXAMPLE 2

In this example the stability of several different bleach-fix solutions was measured. This was done by monitoring the formation of ferrous ion salt in the solution as the ferric-complex salt oxidized other solution constituents. The ferrous ion was measured in the presence of ferric ion and in the presence of other chelating agents by using 1,10-phenanthroline reagent which forms a highly colored ferrous ion complex in weakly acid solution, as described in "Analytical Applications of 1,10-Phenanthroline and Related Compounds", by A. A. Schilt, p. 56.

The bleach-fix formulations are described below:

| Component | Concentration |
|---|---|
| Ammonium thiosulfate | 0.58 M |
| Ammonium sulfite | 0.063 M |
| Ammonium hydroxide | 1.33 M |
| Ferric nitrate.$9H_2O$ | 0.20 M |
| Tridentate compound | See Table 1 |
| Tetradentate compound | See Table 1 |
| Acetic acid | 0.17 M |
| pH | 5.5 |

Small amounts of solution were sealed in sample vials and stored in the dark at room temperature. Every three or four days a vial was opened and the ferrous ion test was performed. The results at 28 days are shown for several comparison solutions and for solutions of this invention, containing two separate chelating compounds. The ligand identification numbers are from List I and List II, respectively.

TABLE I

Ferrous Ion Levels of Sealed Bleach-Fix Solutions After Standing for 28 Days

| | Tridentate | | Tetradentate | | | |
|---|---|---|---|---|---|---|
| Solution No. | Ligand | Conc. (M) | Ligand | Conc. (M) | Ferrous Ion (M) | |
| 1 | I-2 | 0.45 | None | None | 0.088 | Comparison |
| 2 | None | None | II-1 | 0.22 | 0.134 | Comparison |
| 3 | I-2 | 0.25 | II-1 | 0.21 | 0.029 | Invention |
| 4 | I-2 | 0.49 | II-1 | 0.21 | 0.035 | Invention |
| 5 | None | None | II-2 | 0.22 | 0.149 | Comparison |
| 6 | None | None | II-2 | 0.45 | 0.20 | Comparison |
| 7 | I-2 | 0.25 | II-2 | 0.21 | 0.046 | Invention |
| 8 | I-5 | 0.45 | None | None | 0.080 | Comparison |
| 9 | I-5 | 0.25 | II-1 | 0.21 | 0.028 | Invention |
| 10 | I-5 | 0.25 | II-2 | 0.21 | 0.053 | Invention |

It is clear from the results presented in Table I that solutions containing appropriate amounts of each type of chelating compound are much more stable than solutions containing only tridentate ligands or only tetradentate ligands. In solution 6, for example, the sealed samples became colorless because all the ferric ion had been reduced to ferrous ion in the test.

EXAMPLE 3

A silver halide color display material (KODAK DURTRANS RA Display Material), in the form of strips that were 305 mm long and 35 mm wide, was given a suitable exposure to light and then processed using standard color paper processing solutions, except for the bleach-fixes.

| Process Step | Process Time (sec) | Process Temp (°F.) |
|---|---|---|
| Color Development | 110 | 95 |
| Bleach-Fix | * | 95 |
| Water Wash | 220 | 95 |

*The following bleach-fix times were used: 15, 30, 45, 60, 75 sec

The following bleach-fix formations were used:

| | Bleach-Fix A (M) (Invention) | Bleach-Fix B (M) (Comparison) |
|---|---|---|
| Ammonium Thiosulfate | 0.51 | 0.51 |
| Sodium Metabisulfite | 0.046 | 0.046 |
| Acetic Acid | 0.14 | 0.14 |
| II-1 | 0.18 | 0.36 |
| I-2 | 0.43 | 0 |
| Ammonium Hydroxide | 1.87 | 1.87 |
| Ferric Nitrate | 0.179 | 0.179 |
| Silver Chloride | 0.028 | 0.028 |
| pH | 6.2 | 6.2 |

The pH was Adjusted with either acetic acid or ammonium hydroxide.

The material was bleach-fixed for varying lengths of time to determine the speed of silver removal. Residual silver was determined by calculating the difference in IR density between the D-max and D-min steps. Data for IR density differences as a function of time in each bleach-fix are presented in Table II. It is apparent that Bleach-fix A removed silver from the color display material more rapidly than did Bleach-fix B.

TABLE II

Silver (IR D-max - D-min) Remaining in Color Material

| Bleach-Fix Time (sec) | Bleach-Fix A | Bleach-Fix B |
|---|---|---|
| 15 | 1.34 | 1.48 |
| 30 | 1.01 | 1.13 |
| 45 | 0.64 | 0.82 |
| 60 | 0.36 | 0.52 |
| 75 | 0.20 | 0.33 |

EXAMPLE 4

A silver halide color reversal paper (KODAK EKTACHROME Radiance Paper), in the form of strips that were 305 mm long and 35 mm wide, was given a suitable exposure to light and then processed using standard color reversal paper processing solutions, except for the bleach-fixes.

| Process Step | Process Time (sec) | Process Temp (°F.) |
|---|---|---|
| Black and White Development | 75 | 100 |
| Wash | 90 | 100 |
| Color Development | 135 | 100 |
| Wash | 45 | 100 |
| Bleach-Fix | * | 100 |
| Water Wash | 220 | 95 |

*The following bleach-fix times were used: 0, 15, 30, 45, 60, 75 sec

The following bleach-fix formations were used:

| | Bleach-Fix A (M) (Invention) | Bleach-Fix B (M) (Comparison) |
|---|---|---|
| Ammonium Thiosulfate | 0.58 | 0.58 |
| Sodium Metabisulfite | 0.046 | 0.046 |
| II-1 | 0.16 | 0.33 |
| I-2 | 0.40 | 0 |
| Ferric Nitrate | 0.156 | 0.156 |
| 1,2,4-Triazole-3-thiol | 0.003 | 0.003 |
| pH | 7.0 | 7.0 |

The pH was adjusted with either acetic acid or ammonium hydroxide.

The material was bleach-fixed for varying lengths of time to determine the speed of silver removal. Residual silver was determined at step 1 (maximum density) by X-ray fluorescence spectroscopy. Data for residual silver as a function of time in each bleach-fix are presented in Table III. It is apparent that Bleach-fix A removed silver from the color display material more rapidly than did Bleach-fix B.

TABLE III

| Residual Silver (mg/ft$^2$) Remaining in Color Material | | |
|---|---|---|
| Bleach-Fix Time (sec) | Bleach-Fix A | Bleach-Fix B |
| 0 | 109.8 | 109.8 |
| 15 | 82.4 | 89.8 |
| 30 | 45.2 | 57.8 |
| 45 | 22.8 | 32.4 |
| 60 | 2.8 | 13.7 |

EXAMPLE 5

A silver halide color negative film containing <100> tabular silver chloride emulsions such as described in EPO 534,395, published Mar. 31, 1993 (Brust et al.), in the form of strips that were 305 mm long and 35 mm wide, was given a suitable exposure to light and then processed using standard color negative film processing solutions, except for the bleach-fixes.

| Process Step | Process Time (sec) | Process Temp (°F.) |
|---|---|---|
| Color Development | 195 | 100 |
| Bleach-Fix | * | 100 |
| Water Wash | 220 | 95 |

*The following bleach-fix times were used: 0, 15, 30, 60, 90, 120, 240 sec

The following bleach-fix formations were used:

| | Bleach-Fix A (M) (Invention) | Bleach-Fix B (M) (Comparison) |
|---|---|---|
| Ammonium Thiosulfate | 1.02 | 1.02 |
| Sodium Metabisulfite | 0.092 | 0.092 |
| II-1 | 0.36 | 0.72 |
| I-2 | 0.90 | 0 |
| Ferric Nitrate | 0.358 | 0.358 |
| pH | 6.2 | 6.1 |

The pH was adjusted with either acetic acid or ammonium hydroxide.

The film was bleach-fixed for varying lengths of time to determine the speed of silver removal. Residual silver was determined by calculating the difference in IR density between the D-max and D-min steps. Data for IR density differences as a function of time in each bleach-fix are presented in Table IV. It is apparent that Bleach-fix A removes silver from the film more rapidly than does Bleach-fix B.

TABLE IV

| Residual Silver (IR D-Max - D-min) Remaining in Color Material | | |
|---|---|---|
| Bleach-Fix Time (sec) | Bleach-Fix A | Bleach-Fix B |
| 0 | 1.39 | 1.39 |
| 15 | 1.12 | 1.15 |
| 30 | 1.02 | 1.11 |
| 60 | 0.92 | 0.98 |
| 90 | 0.68 | 0.89 |
| 120 | 0.60 | 0.67 |
| 240 | 0.01 | 0.20 |

EXAMPLE 6

A silver halide color paper (KODAK EKTACOLOR EDGE Paper), in the form of strips that were 305 mm long and 35 mm wide, was given a suitable exposure to light and then processed using standard color paper processing solutions, except for the bleach-fixes.

| Process Step | Process Time (sec) | Process Temp (°F.) |
|---|---|---|
| Color Development | 45 | 95 |
| Bleach-Fix | 45 | 95 |
| Water Wash | 90 | 95 |

The following bleach-fix formations were used:

| | Bleach-Fix A (M) (Invention) | Bleach-Fix B (M) (Comparison) |
|---|---|---|
| Ammonium Thiosulfate | 0.51 | 0.51 |
| Sodium Metabisulfite | 0.046 | 0.046 |
| II-1 | 0.18 | 0 |
| I-2 | 0.45 | 0.45 |
| Ferric Nitrate | 0.179 | 0.179 |
| pH | 6.2 | 6.2 |

The pH was adjusted with either acetic acid or ammonium hydroxide.

Residual iron was measured by X-ray fluorescence. The data are presented in Table V. It is apparent that Bleach-fix A (invention) does not leave as much residual iron in the paper as does Bleach-fix B.

TABLE V

| Residual Iron (mg/ft$^2$) Remaining in Color Material | |
|---|---|
| Bleach-Fix A | Bleach-Fix B |
| 0.7 | 2.4 |

EXAMPLE 7

A silver halide color paper, containing an experimental two-equivalent magenta coupler as disclosed in WO 92/18902 by Pawlak et al., in the form of strips that were 305 mm long and 35 mm wide, was given a suitable exposure to light and then processed using standard color paper processing solutions, except for the bleach-fixes.

| Process Step | Process Time (sec) | Process Temp (°F.) |
|---|---|---|
| Color Development | 45 | 95 |
| Bleach-Fix | * | 95 |
| Water Wash | 90 | 95 |

*The following bleach-fix times were used: 0, 10, 20, 30, 40 sec

The following bleach-fix formations were used:

| | Bleach-Fix A (M) (Invention) | Bleach-Fix B (M) (Comparison) |
|---|---|---|
| Ammonium Thiosulfate | 0.51 | 0.51 |
| Sodium Metabisulfite | 0.046 | 0.046 |
| II-1 | 0.18 | 0.36 |
| I-2 | 0.45 | 0 |
| Ferric Nitrate | 0.179 | 0.179 |
| Silver Chloride | 0.028 | 0.028 |
| pH | 6.2 | 6.2 |

The pH was adjusted with either acetic acid or ammonium hydroxide.

The paper was bleach-fixed for varying lengths of time to determine the speed of silver removal. Residual silver was determined by calculating the difference in IR density between the D-max and D-min steps. Data for IR density differences as a function of time in each bleach-fix are presented in Table VI. It is apparent that Bleach-fix A removes silver from the paper more rapidly than does Bleach-fix B.

TABLE VI

| Silver (IR D-max - D-min) Remaining in Color Material | | |
|---|---|---|
| Bleach-Fix Time (sec) | Bleach-Fix A | Bleach-Fix B |
| 0 | 0.93 | 0.93 |
| 10 | 0.62 | 0.63 |
| 20 | 0.37 | 0.38 |
| 30 | 0.26 | 0.31 |
| 40 | 0.14 | 0.20 |

EXAMPLE 8

A silver halide color paper (KODAK EKTACOLOR EDGE Paper), in the form of strips that were 305 mm long and 35 mm wide, was given a suitable exposure to light and then processed using standard color paper processing solutions, except for the bleach-fixes.

| Process Step | Process Time (sec) | Process Temp (°F.) |
|---|---|---|
| Color Development | 45 | 95 |
| Bleach-Fix | * | 95 |
| Water Wash | 90 | 95 |

*The following bleach-fix times were used: 0, 10, 20, 30, 45 sec

The following bleach-fix formations were used:

| | Bleach-Fix A (M) |
|---|---|
| Ammonium Thiosulfate | 0.42 |
| Sodium Metabisulfite | 0.066 |
| Acetic Acid | 0.175 |
| Ligand 1 | see Table VII |
| Ligand 2 | see Table VII |
| Ferric Nitrate | 0.107 |
| Silver Chloride | 0.028 |
| pH | 6.2 |

The pH was adjusted with either acetic acid or ammonium hydroxide.

TABLE VII

| Variation | Ligand 1 (M) | Ligand 2 (M) |
|---|---|---|
| 1 | II-1 (0.109) | I-5 (0.108) |
| 2 | II-1 (0.109) | I-2 (0.217) |
| 3 | II-2 (0.108) | I-5 (0.108) |
| 4 | II-1 (0.214) | — |
| 5 | II-1 (0.118) | — |
| 6 | II-2 (0.214) | — |

The element was bleach-fixed for varying lengths of time to determine the speed of silver removal. Residual silver was determined by calculating the difference in IR density between the D-max and D-min steps. Data for IR density differences as a function of time in .each bleach-fix are presented in Table VIII. It is apparent that bleach-fix formulations of the invention (1, 2, and 3) remove silver from the color paper more rapidly than do comparative bleach-fix formations (like 4, 5, and 6).

TABLE VIII

| Variation | 0 sec | 10 sec | 20 sec | 30 sec | 45 sec |
|---|---|---|---|---|---|
| 1 (Inv) | 1.06 | 0.84 | 0.51 | 0.26 | 0.06 |
| 2 (Inv) | 1.06 | 0.79 | 0.51 | 0.32 | 0.06 |
| 3 (Inv) | 1.06 | 0.75 | 0.36 | 0.16 | 0.06 |
| 4 (Comp) | 1.06 | 0.84 | 0.61 | 0.41 | 0.11 |
| 5 (Comp) | 1.06 | 0.89 | 0.70 | 0.53 | 0.37 |
| 6 (Comp) | 1.06 | 0.84 | 0.56 | 0.30 | 0.09 |

EXAMPLE 9

A silver halide color paper single layer containing <100> tabular silver chloride emulsions such as described in EPO 534,395, published Mar. 31, 1993 (Brust et al), in the form of strips that were 305 mm long and 35 mm wide, was given a suitable exposure to light and then processed using standard color negative film processing solutions, except for the bleach-fixes.

| Process Step | Process Time (sec) | Process Temp (° F.) |
|---|---|---|
| Color Development | 45 | 95 |
| Bleach-Fix | * | 95 |
| Water Wash | 90 | 95 |

*The following bleach-fix times were used: 0, 10, 20, 30, 40 sec

The following bleach-fix formulations were used:

| | Bleach-Fix A (M) (Invention) | Bleach-Fix B (M) (Comparison) |
|---|---|---|
| Ammonium Thiosulfate | 0.178 | 0.178 |
| Sodium Metabisulfite | 0.018 | 0.018 |
| II-1 | 0.067 | 0.133 |
| I-2 | 0.168 | 0 |
| Ferric Nitrate | 0.067 | 0.067 |
| pH | 6.2 | 6.2 |

The pH was adjusted with either acetic acid or ammonium hydroxide.

The material was bleach-fixed for varying lengths of time to determine the speed of silver removal. Residual silver was determined at step 1 (maximum density) by X-ray fluorescence spectroscopy. Data for residual silver as a function of time in each bleach-fix are presented in Table IX. It is apparent that Bleach-fix A removes silver from the color display material more rapidly than does Bleach-fix B.

TABLE IX

| Residual Silver (mg/ft$^2$) Remaining in Color Material | | |
|---|---|---|
| Bleach-Fix Time (sec) | Bleach-Fix A | Bleach-Fix B |
| 0 | 27.7 | 27.7 |
| 10 | 17.7 | 19.1 |
| 20 | 5.4 | 13.2 |
| 30 | 1.8 | 5.8 |
| 40 | 0 | 2.7 |

The invention has been described in detail with particular reference to preferred embodiments thereof, but it will be understood that variations and modifications can be effected within the spirit and scope of the invention.

What is claimed is:

1. A composition for bleach-fixing an imagewise exposed and developed silver halide photographic element comprising a fixing agent present in an amount of from 0.1 to 3 mol/l, and a ternary ferric-complex salt formed by a tetradentate ligand and a tridentate ligand, wherein the ratio of tetradentate ligand to ferric ion is in the range of from 0.9 to 1.5 and the ratio of tridentate ligand to ferric ion is in the range of from 0.5 to 10, and the amount of ferric ion is from 0.01 to 1 mol/l, wherein said tridentate ligand is represented by Formula I and said tetradentate ligand is represented by Formula II

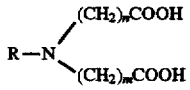

(I)

-continued

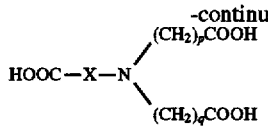

(II)

wherein R is H or an alkyl group, X is a linking group, m and n are 1, 2 or 3, and p and q are 1.

2. The composition of claim 1 wherein R is an H or an alkyl group of 1 to 3 carbon atoms and m and n are 1.

3. The composition of claim 1 wherein x is an alkylene group of 1 to 3 carbon atoms.

4. The composition of claim 1 wherein the tridentate ligand is methylaminodiacetic acid and the tetradentate ligand is nitrilotriacetic acid.

5. The composition of claim 1 wherein the pH is 3 to 8.

6. The composition of claim 1 wherein the pH is 4.0 to 6.5.

7. The composition of claim 1 wherein the ratio of tetradentate ligand to ferric ion is in the range of 1.0 to 1.2 and the ratio of tridentate ligand to ferric ion is in the range of 1.0 to 3.

8. The composition of claim 1 wherein the fixing agent is a thiosulfate.

9. The composition of claim 3 wherein the tridentate ligand is methylaminodiacetic acid and the tetradentate ligand is nitrilotriacetic acid.

10. A method of desilvering an imagewise exposed and developed silver halide photographic element comprising processing the silver halide element in a bleach-fix composition comprising a fixing agent present in an amount of from 0.1 to 3 mol/l, and a ternary ferric-complex salt formed by a tetradentate ligand and a tridentate ligand, wherein the ratio of tetradentate ligand to ferric ion is in the range of from 0.9 to 1.5 and the ratio of tridentate ligand to ferric ion is in the range of from 0.5 to 10, and the amount of ferric ion is from 0.01 to 1 mol/l, wherein said tridentate ligand is represented by Formula I and said tetradentate ligand is represented by Formula II

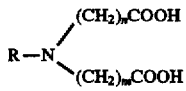

(I)

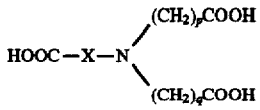

(II)

wherein R is H or an alkyl group, X is a linking group, m and n are 1, 2 or 3, and p and q are 1.

11. The method of claim 10 wherein R is an H or an alkyl group of 1 to 3 carbon atoms and m and n are 1.

12. The method of claim 10 wherein X is an alkylene group of 1 to 3 carbon atoms.

13. The method of claim 10 wherein R is an H or an alkyl group of 1 to 3 carbon atoms; X is alkylene of 1 to 3 carbon atoms; and m, n, p and q are 1.

14. The method of claim 10 wherein the tridentate ligand is methylaminodiacetic acid and the tetradentate ligand is nitrilotriacetic acid.

15. The method of claim 10 wherein the pH is 3 to 8.

16. The method of claim 10 wherein the pH is 4.0 to 6.5.

17. The method of claim 10 wherein the ratio of tetradentate ligand to ferric ion is in the range of 1.0 to 1.2 and the ratio of tridentate ligand to ferric ion is in the range of 1.0 to 3.

18. The method of claim 10 wherein the fixing agent is a thiosulfate.

19. The composition of claim 1 wherein said ferric ion is present in an amount of from 0.05 to 0.4 mol/l, and said fixing agent is present in an amount of from 0.2 to 1.5 mol/l.

20. The method of claim 10 wherein said ferric ion is present in an amount of from 0.05 to 0.4 mol/l, said fixing agent is present in an amount of from 0.2 to 1.5 mol/l, the ratio of tetradentate ligand to ferric ion is from 1.0 to 1.2, and the ratio of tridentate ligand to ferric ion is from 1.0 to 3.

21. The method of claim 20 wherein the ratio of tetradentate ligand to ferric ion is from 1.01 to 1.05.

* * * * *